US005871237A

United States Patent [19]

Hunt

[11] Patent Number: 5,871,237

[45] Date of Patent: Feb. 16, 1999

[54] ENHANCED CHILDREN'S BOOK HAVING ROTATABLE MECHANICAL FEATURES

[75] Inventor: Waldo Henley Hunt, Encino, Calif.

[73] Assignee: Intervisual Books, Santa Monica, Calif.

[21] Appl. No.: 820,894

[22] Filed: Mar. 19, 1997

[51] Int. Cl.[6] ..... B42D 1/00; B42D 3/18; B42D 15/00

[52] U.S. Cl. ..... 281/21.1; 281/15.1; 281/51; 283/63.1; 283/99

[58] Field of Search ..... 283/99, 98, 117, 283/63.1; 281/15.1, 28, 21.1, 51, 38, 16; 446/147, 149, 151, 152; 443/103, 104

[56] References Cited

U.S. PATENT DOCUMENTS

| | | | |
|---|---|---|---|
| 256,761 | 4/1882 | Strong . | |
| 258,261 | 5/1882 | Stockton . | |
| 299,015 | 5/1884 | Sales . | |
| 639,679 | 12/1899 | Kaufmann . | |
| 800,494 | 9/1905 | Schwahn . | |
| 900,135 | 10/1908 | Vollmer . | |
| 976,495 | 11/1910 | Reeves . | |
| 1,041,573 | 10/1912 | Baring-Gould . | |
| 1,681,776 | 8/1928 | McDonnell . | |
| 2,367,373 | 1/1945 | Ralston . | |
| 2,389,085 | 11/1945 | Sagendorf . | |
| 2,432,318 | 12/1947 | Leech . | |
| 2,476,742 | 7/1949 | Lareau et al. . | |
| 2,572,703 | 10/1951 | Dennis | 281/51 |
| 2,915,842 | 12/1959 | Finnell . | |
| 3,235,988 | 2/1966 | Paige . | |
| 3,486,270 | 12/1969 | Maher . | |
| 3,633,301 | 1/1972 | Calabuig . | |
| 4,104,809 | 8/1978 | Day et al. . | |
| 4,341,035 | 7/1982 | Jaworski et al. . | |
| 4,865,574 | 9/1989 | Kobayashi . | |
| 5,246,252 | 9/1993 | Gaddis . | |
| 5,246,253 | 9/1993 | Mykrantz | 283/117 |
| 5,358,280 | 10/1994 | Scales | 283/63.1 |
| 5,580,098 | 12/1996 | Gates . | |

*Primary Examiner*—Larry I. Schwartz
*Assistant Examiner*—Tisa Stewart
*Attorney, Agent, or Firm*—Oppenheimer Wolff & Donnelly LLP

[57] ABSTRACT

An enhanced children's book includes a plurality of pages bound between covers along a spine. At least one of the pages includes a recto sheet, a verso sheet, and an inner member. The recto and verso sheets are adhered together to define an inner space in which the inner member is slidably received. The recto and verso sheets are cut to define a bound portion and a movable portion of the page. The inner member is rotatably attached to the bound portion of the page, and the movable portion is rotatably attached to the inner member. The movable portion is rotatable between a normal position in which the page is normally configured and an extended position in which a portion of the inner member is exposed. The inner member is rotatable between a normal position in which a minimal portion of the inner member is exposed and an extended position in which a maximal portion of the inner member is exposed.

18 Claims, 3 Drawing Sheets

ENHANCED CHILDREN'S BOOK HAVING ROTATABLE MECHANICAL FEATURES

FIELD OF THE INVENTION

The present invention relates to books and, more particularly, to books with mechanical or "pop-up" features.

BACKGROUND OF THE INVENTION

Mechanical features, often referred to as "pop-up" features, are ubiquitous in books intended for young children who have not yet learned to read or who read at a very preliminary level. Sophisticated mechanical features are often used in books for older children to provide mechanical animation to the story. Typically speaking, the more sophisticated pop-up features are more intricate and, therefore, more delicate than those intended for the often abusive hands of infants and young children.

Along these lines, pop-up features in books for young children need to be substantially durable so as to withstand rough treatment from the children. A challenge for the producers of children's books is to develop pop-up features which are sufficiently durable to endure abuse yet sophisticated enough to retain the interest of the reader. Books which are able to incorporate pop-up features which meet these criteria enjoy popularity and success in the marketplace. Examples of such popular and successful books are produced by The Hunt Group and Intervisual Books, Inc., of Santa Monica, Calif., with one example being U.S. Pat. No. 5,580,098 granted Dec. 3, 1996.

In order to maintain a market share, producers need to develop new and different mechanical features constantly. Accordingly, there remains a need in the art of paper engineering and children's books for mechanical or pop-up features which are both durable and interesting.

SUMMARY OF THE INVENTION

According to one aspect of the present invention, an enhanced children's book has a rotatable mechanical feature which enables a movable portion of a page to be rotated away from a bound portion of the page. Illustrations and/or text printed on the movable and bound portions of the page may correspond to and complement the animation resulting from actuation of the rotatable mechanical feature.

In accordance with another aspect of the invention, each page of the book has a recto sheet (i.e., a front sheet) and a verso sheet (i.e., a back sheet). An inner member is received between the recto sheet and verso sheets of the page. As the movable portion is rotated away from the bound portion, the inner member becomes exposed. Such a rotating mechanical feature which reveals new visual subject matter provides interaction with the reader. Accordingly, children who may have become bored with conventional pop-up features may find such rotating action exciting and interesting.

According to a further aspect of the present invention, both the inner member and the movable portion rotate with respect to the bound portion. The inner member is slidably received between the recto and verso sheets and is rotatable with respect to the bound portion of the page. The movable portion may be rotatably attached to the inner member, and the inner member may be rotatably attached to the bound portion; or these two parts may be pivoted together to the bound portion. As the movable portion is rotated away from the bound portion, the inner member becomes exposed; and as the inner member rotates away from the bound portion, an even greater portion of the inner member becomes exposed.

With such a configuration, the illustrations and/or text printed on the page may be devised so as to pose a question, for example, on the recto (or verso) sheet, with the actuation of the rotatable mechanical feature providing an answer on the exposed inner member. Alternatively, an incomplete phrase may be provided with the actuation of the mechanical feature completing the phrase. Such a combination of illustrations and/or associated text and rotating mechanical feature is synergistic in captivating the child audience. Further, as it is preferable for the recto and verso sheets to be made of substantially durable sheet material, the rotating mechanical feature is durable and able to withstand repeated and often misdirected use from children.

Yet another aspect of the present invention is the provision of a window formed in the recto sheet and/or the verso sheet. Accordingly, a portion of the inner member which is visible through the window may provide a clue as to what illustration is to be exposed on the inner member upon actuation of the rotatable mechanical feature.

According to a preferred embodiment of the present invention, an enhanced children's book includes a plurality of pages bound between covers along a spine. At least one of the pages includes a recto sheet, a verso sheet, and an inner member disposed between the recto and verso sheets. The recto and verso sheets are adhered together such that an inner space is defined therebetween in which the inner member is slidably received. The recto and verso sheets are cut to define a bound portion and a movable portion of the page, with the bound portion being bound along the spine. The inner member is rotatably attached to the bound portion, and the movable portion is rotatably attached to the inner member. The movable portion is rotatable between a normal position in which edges formed by cutting the recto and verso sheets are substantially coextensive and an extended position in which the inner member is exposed. The inner member is rotatable between a normal position in which a minimal portion of the inner member is exposed and an extended position in which a maximal portion of the inner member is exposed.

Other aspects and features of the enhanced children's book of the present invention will become apparent to those skilled in the art from the following detailed description of the preferred embodiments of the invention, with reference to the accompanying drawings.

DETAILED DESCRIPTION OF THE PREFERRED EMBODIMENTS

Figure 1:
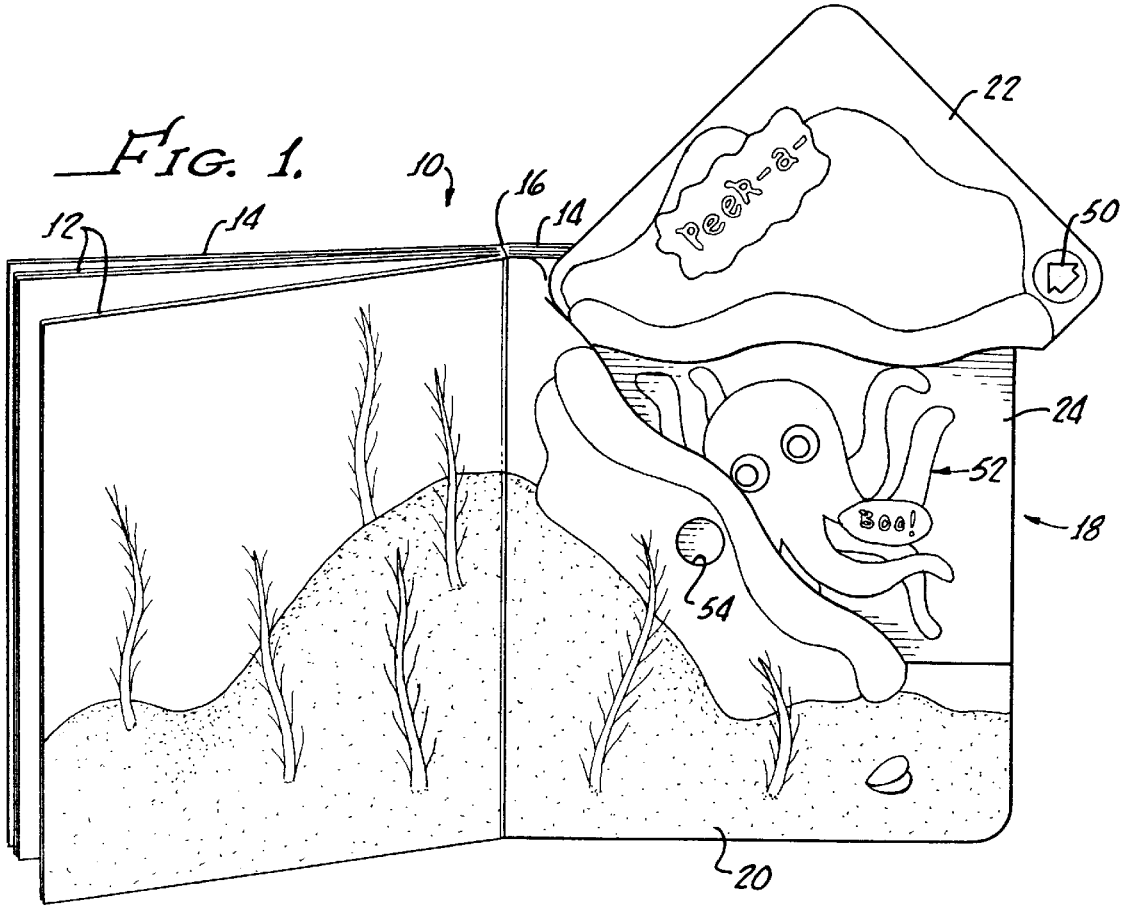
FIG. 1 is a perspective view of an enhanced children's book having rotatable mechanical features in accordance with the present invention.

Referring to FIG. 1 of the drawings, an enhanced children's book 10 in accordance with the present invention includes a plurality of pages 12 bound between covers 14 along a spine 16. A selected number of the pages 12 are configured with a rotatable mechanical feature 18. A bound portion 20 of the page 12 is defined as the portion of the page 12 bound along the spine 16. A movable portion 22 of the page 12 is rotatable with respect to the bound portion 20 and defines one aspect of the rotatable mechanical feature 18. An inner member 24 defines a second aspect of the rotatable mechanical feature 18 and is also preferably rotatable with respect to the bound portion 20 of the page 12, which will be described in detail below.

Figure 2:
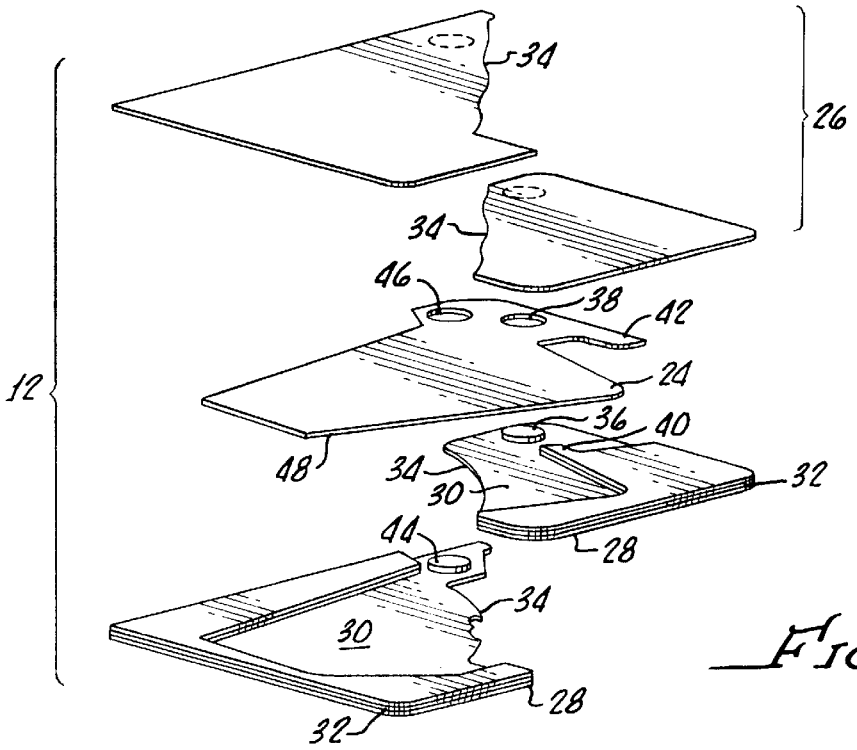
FIG. 2 is an exploded view of a page of the enhanced children's book of the present invention, particularly illustrating an exemplary structure of one of the rotatable mechanical features.

With additional reference to FIG. 2, each of the pages 12 includes a recto sheet 26 and a verso sheet 28. (The recto and verso sheets 26 and 28 are more clearly illustrated in FIG. 4.) The term recto refers to the side of a page which lies to the right in an open book, and the term verso refers to the side of a page which lies to the left in an open book. In those pages incorporating a rotatable mechanical feature, the inner member 24 is slidably received between the recto and verso sheets 26 and 28 within an inner space 30 defined between the sheets. The inner space 30 may be formed by perimetrically adhering the recto and verso sheets 26 and 28 together such that the central area of the page 12 is free from adhesive. Preferably, a spacer 32 having about the same thickness as that of the inner member 24 is provided to define the inner space 30 so that the inner member 24 is able to slide in the inner space 30 between the recto and verso sheets 26 and 28 without hinderance from excessive friction between the contacting surfaces. The page 12 (i.e., the recto and verso sheets 26 and 28) is cut to define the bound portion 20 and the movable portion 22, thereby defining an edge 34 along each of the portions 20 and 22 of the page 12.

Figure 3:
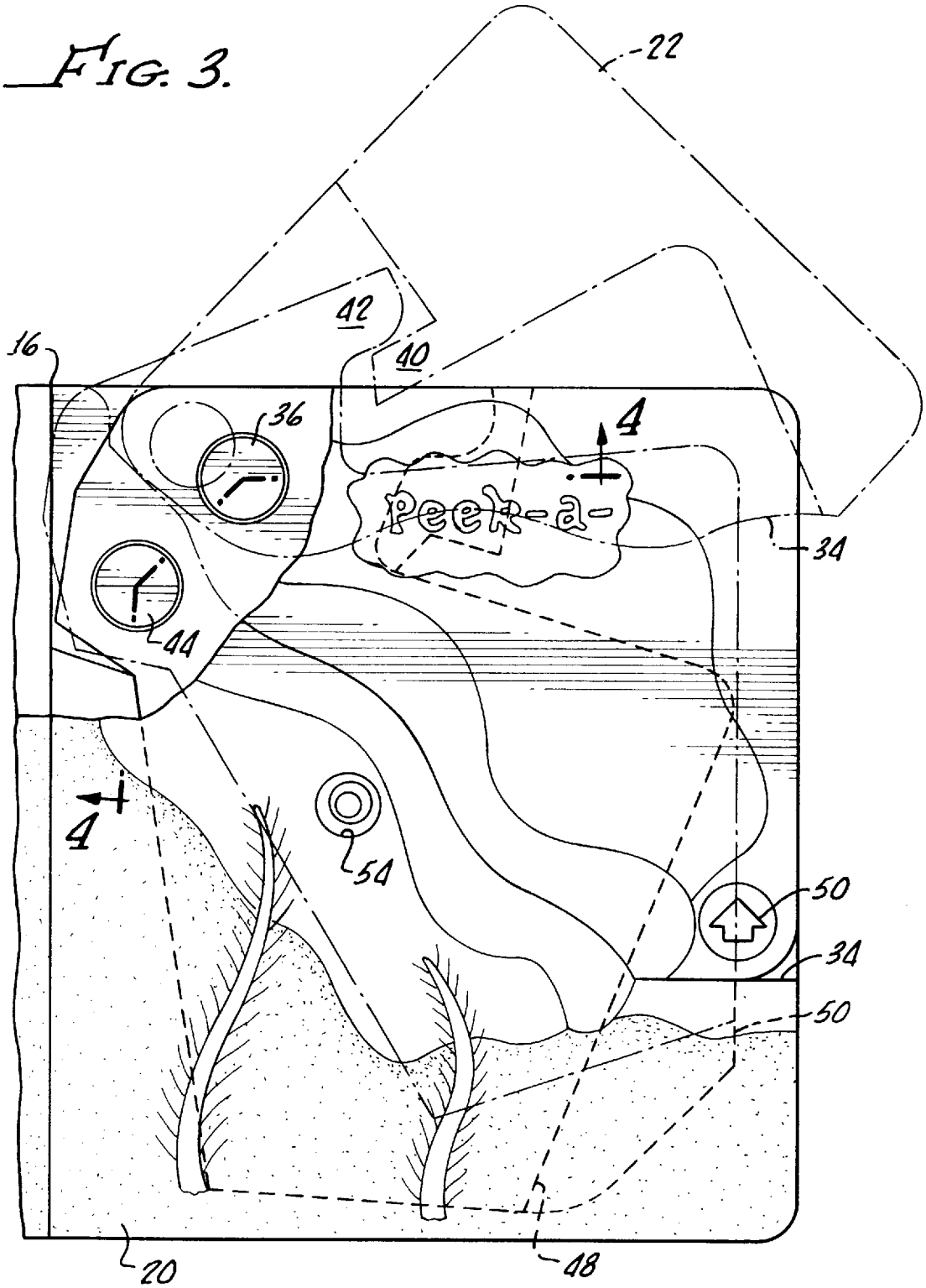
FIG. 3 is a plan view, partially cut away, of a recto side of a page of the enhanced children's book of the present invention, particularly illustrating the movement of one of the rotatable mechanical features.

Referencing FIG. 3, the movable portion 22 may be rotatably attached to the either the bound portion 20 or the inner member 24, but is preferably attached to the inner member 24 by a first axle 36 rotatably received within a first aperture 38. Accordingly, the movable portion 22 is rotatable about an axis defined by the first axle 36. Outward rotation of the movable portion 22 is restricted by a stop 40 formed on the movable portion 22 abutting a catch 42 formed on the inner member 24. Inward rotation of the movable portion 22 is restricted by edge 34 of the movable portion 22 abutting edge 34 of the bound portion 20.

Figure 4:
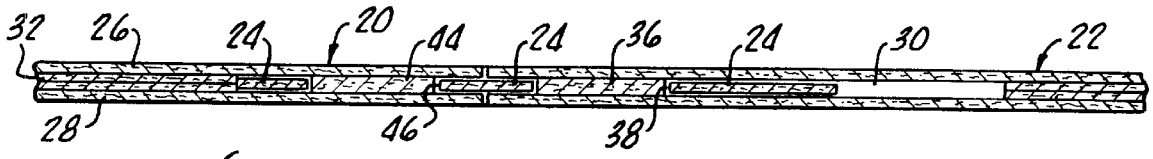
FIG. 4 is a cross-sectional view of a page of the enhanced children's book, taken along line 4—4 of FIG. 3.

With additional reference to FIG. 4, the inner member 24 is preferably rotatably attached to the bound portion 20 by a second axle 44 rotatably received within a second aperture 46. Accordingly, the inner portion 24 is rotatable about an axis defined by the second axis 44. Outward rotation of the inner member 24 is restricted by a stop edge 48 of the inner member 24 abutting a catch edge 50 formed on the bound portion 20. Inward rotation of the inner portion 24 is restricted by an inner edge of the inner member 24 abutting an edge of the inner space 30.

The first and second axles 36 and 44 are preferably located near the spine 16 so that the movable portion 22 and the inner member 24 are rotatable out of and away from the bound portion 20. Further, by placing the axes of rotation near the spine 16, the movable portion 22 may encompass a greater portion of the page 12, thereby creating a greater visual effect and enabling the movable portion 22 to rotate substantially beyond the normal dimensions of the page 12. In addition, It is preferable but not necessary for the rotation of the movable portion 22 and the inner member 24 to be substantially planar, either coplanar or in a parallel plane, with the bound portion 20.

To operate the rotatable mechanical feature 18, the movable portion 20 is urged upward from a normal position, which may be indicated by an arrow indicia 50, exposing a substantial portion of the inner member 24 previously hidden by the recto sheet 26 of the movable portion 22. When the stop 40 of the movable portion 22 abuts the catch 42 of the inner member 24, the inner member 24 begins to rotate along with the movable member 22, thereby exposing portions of the inner member 24 previously hidden by the recto sheet 26 of the bound portion 20, defining a widening space between the movable portion 22 and the bound portion 20, and placing the page 12 in an extended position. Alternatively, the inner member 24 may rotate along with the movable portion 22 prior to the stop 40 abutting the catch 24 due to slight frictional forces or pressing of the recto and verso sheets 26 and 28 together. From the extended position, the movable portion 22 may be urged back toward to bound portion 20 to restore the page 12 to the normal position.

According to the preferred embodiment of the enhanced children's book 10 illustrated in FIGS. 1 and 3, illustrations and/or text 52 may be printed on the recto and verso sheets 26 and 28 and on the inner member 24. A portion of the illustrations and/or text 52 of the recto sheet 26 (or verso sheet 28) preferably corresponds or is complementary to that of the inner member 24.

In addition, the illustrated preferred embodiment of the book 10 may have a window 54 formed in the recto sheet 26 (or verso sheet 28) of the page 12 incorporating one of the rotatable mechanical features 18, either in the bound portion 20 as shown or in the movable portion 22. The illustrations 52 of the inner member 24 are visible through the window 54 to provide a child a hint at what may be exposed upon actuating the rotatable mechanical feature 18.

Another feature of the preferred embodiment of the present invention is that the edges 34 of the bound and movable portions 20 and 22 are preferably cut in such a way as to complement and/or correspond to the illustrations and/or text 52. For example, as specifically shown in FIG. 1, the page 12 is cut so that the edges 34 of the bound portion 20 and the movable portion 22 define the outline of a giant clam illustrated on the page. Further, an eye of an octopus hiding in the giant clam is visible through the window 54.

Figure 5:
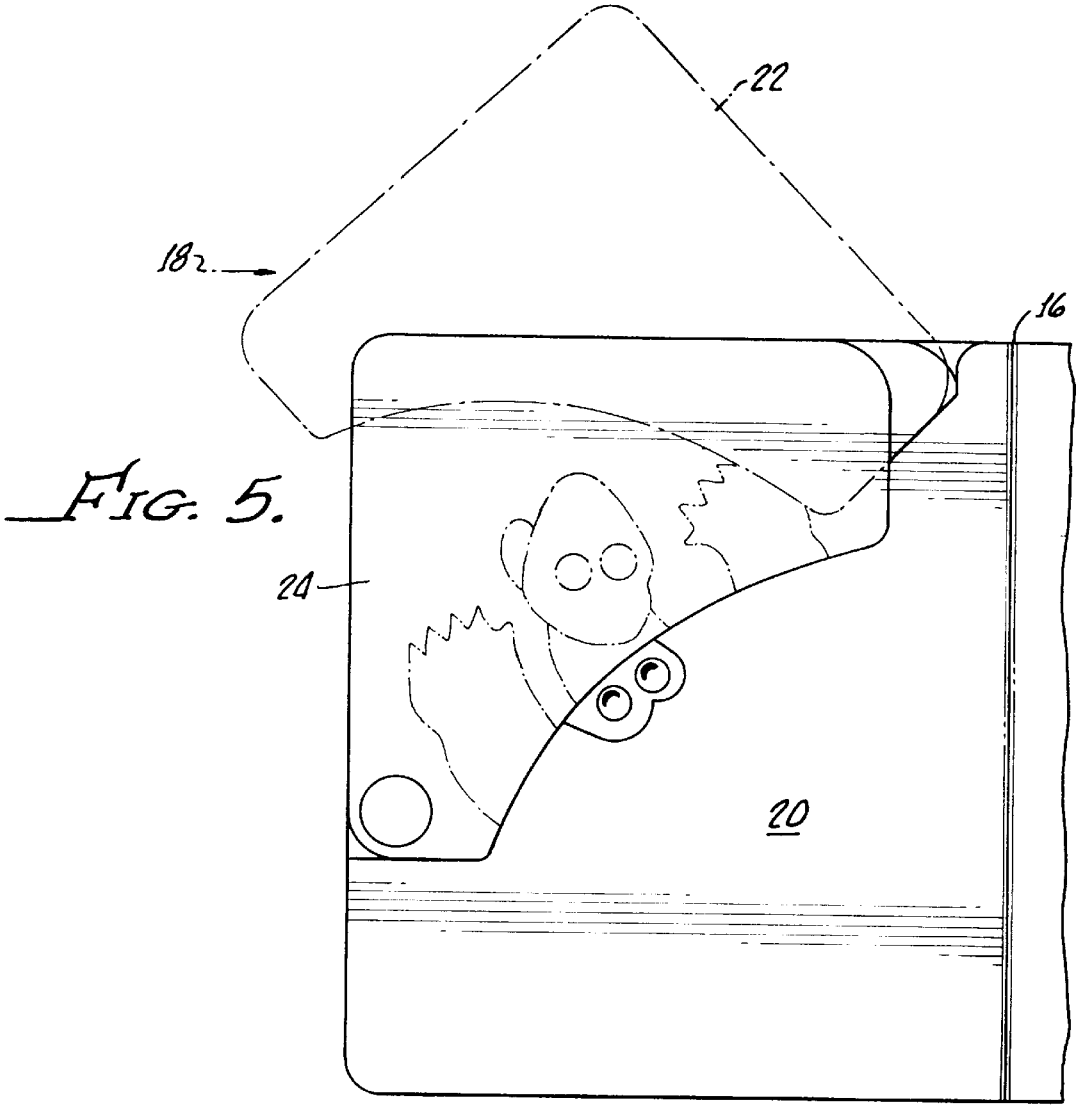
FIG. 5 is a plan view of a verso side of page of the enhanced children's book of the present invention, particularly illustrating an exemplary relationship between the recto side and the verso side of a page configured with a rotatable mechanical feature.

With reference to FIG. 5, the verso side of the page 12 corresponding to the recto side shown in FIGS. 1 and 3 is illustrated. The page 12 is preferably configured with the rotatable mechanical feature 18 so that the movable portion 22 of the page is actuatable from either the recto side or the verso side of the page. The rotatable mechanical feature 18 on the verso side is preferably configured analogously with respect to its structure and operation to that described above. Alternatively, either one of the sheets 26 or 28 may be fixed with respect to the other, or may be bound to the bound portion 20.

According to a preferred embodiment of the enhanced children's book 10, the movable portion 22 is rotatable through approximately 15° to 30° with respect to the inner member 24, and the inner member 24 is rotatable through approximate 15° to 30° with respect to the bound portion 20. Accordingly, when in the fully extended position, the movable portion 22 may have rotated through approximately 30° to 60° with respect to the bound portion 20. Although these are preferred ranges of rotation, the rotatable mechanical feature 18 may be configured to rotate through any desired range.

In addition, it is preferable for the movable portion 22 to encompass a substantial portion of the page 12. As illustrated, the recto and verso sheets 26 and 28 are cut generally diagonally across the page 12 so that the movable portion 22 encompasses more than a quarter of the page 12. Preferably, the movable portion 22 encompasses at least about one-tenth to about one-half of the page 12. Accordingly, when in the extended position, the movable portion 22 projects a substantial distance beyond the bound portion 20 of the page 12.

Moreover, as an intended audience for the enhanced children's book 10 of the present invention is young children, it is preferable for the recto and verso sheets 26 and 28, as well as the inner member 24, to be made from substantially durable sheet material. An example of such sheet material may be pressboard or paperboard having a thickness of about 10 mils to about 70 mils and preferably about 30 mils.

Many alternatives and modifications of the enhanced children's book 10 according to the present invention are possible. For example, one of the pages 12 may be configured with a rotatable mechanical feature which does not include an inner member. In this embodiment, the movable portion is rotatably attached to the bound portion. Accordingly, when the movable portion rotates outwardly, the page separates so that a widening space is formed between the movable portion and the bound portion. The edges 34 may be configured like the teeth of a shark or other animal for a child's enjoyment. Further, the inner member 24 of the rotatable mechanical feature 18 may be fixed to the bound portion 20 or, alternatively, to the movable portion 22. Additional pop-up features may be incorporated with the rotatable mechanical feature 18 as known in the art. Also, a single axle/aperture configuration may be used to rotatably attach the movable portion and the inner member to the bound portion. It is to be understood that all such modifications and alternatives of the enhanced children's book are within the scope of the present invention as set forth in the following claims.

What is claimed is:

1. A book comprising:

a plurality of pages bound between covers along a spine;

at least one of the pages including:

a bound portion bound along the spine;

a movable portion including an inner space; and an inner member slidably received within the inner space of the movable portion;

the movable portion being rotatable with respect to the inner member from a normal position in which the inner member is substantially concealed from view and an extended position in which a portion of the inner member is exposed.

2. The book of claim 1 wherein the bound portion includes an inner space;

the inner member being slidably received within the inner space of the bound portion and being rotatable with respect to the bound portion.

3. The book of claim 2 wherein the movable portion is rotatable through approximately 30° with respect to the inner member, and the inner member is rotatable through approximately 30° with respect to the bound portion.

4. The book of claim 1 wherein the movable portion includes a recto sheet and a verso sheet such that the movable portion is actuatable from a recto side and a verso side of the page.

5. A book comprising:

a plurality of pages bound between covers along a spine;

at least one of the pages being cut to define a bound portion and a movable portion;

the bound portion being bound along the spine; and the movable portion being rotatably attached to the bound portion;

the movable portion being rotatable from a normal position in which edges of the bound portion and the movable portion are coextensive along a substantial length thereof and an extended position in which a widening space is defined between the edges of the bound portion and the movable portion.

6. The book of claim 5 wherein said at least one page includes a recto sheet, a verso sheet, and an inner member received between the recto and verso sheets;

whereby the inner member is substantially hidden from view when the movable portion is in the normal position and substantially visible when the movable portion is in the extended position.

7. The book of claim 6 wherein the recto sheet is connected to the verso sheet to define an inner space therebetween;

the inner member being slidably received within the inner space.

8. The book of claim 6 wherein the movable portion is rotatably attached to the inner member, and the inner member is rotatably attached to the bound portion.

9. An enhanced children's book having rotatable mechanical features, comprising:

a plurality of pages bound between covers along a spine;

at least one of the pages including a recto sheet, a verso sheet, and an inner member;

the recto and verso sheets being connected together to form an inner space therebetween, the inner member being slidably received in the inner space;

the recto and verso sheets being cut to define a bound portion and a movable portion of the at least one page;

the bound portion of the page at least one being bound along the spine;

the inner member being rotatably attached to the bound portion of the page at least one; and the movable portion of the page at least one being rotatably attached to the inner member.

10. The book of claim 9 wherein the movable portion of the at least one page is rotatable between a normal position in which edges formed by cutting the recto and verso sheets are substantially coextensive and an extended position in which the inner member is exposed.

11. The book of claim 10 further comprising a stop for preventing the movable portion of the page at least one from rotating beyond the extended position.

12. The book of claim 9 wherein the inner member is rotatable between a normal position in which a minimal portion of the inner member is exposed and an extended position in which a maximal portion of the inner member is exposed.

13. The book of claim 12 further comprising a stop for preventing the inner member from rotating beyond the extended position.

14. The book of claim 9 further comprising an axle and an aperture for rotatably attaching the movable portion to the inner member.

15. The book of claim 9 further comprising an axle and an aperture for rotatable attaching the inner member to the bound portion.

16. The book of claim 9 wherein the page further includes a spacer positioned between the recto sheet and the verso sheet to define the inner space.

17. The book of claim 16 wherein the spacer has a thickness substantially equal to that of the inner member.

18. The book of claim 9 further comprising a window formed in at least one of the recto and verso sheets through which a portion of the inner member is visible.

* * * * *